United States Patent [19]

Norman

[11] 4,262,385

[45] Apr. 21, 1981

[54] WEIGHT-CUSHIONING DEVICE FOR HANDLES AND METHOD OF CONSTRUCTING SAME

[76] Inventor: Bill Norman, 14431 Galy, Tustin, Calif. 92680

[21] Appl. No.: 130

[22] Filed: Jan. 2, 1979

[51] Int. Cl.[3] ..... B65D 63/18

[52] U.S. Cl. ..... 16/114 R; 16/125; 112/441; 294/137

[58] Field of Search ..... 224/45 P, 45 S, 264; 280/11.37 A; 112/405, 418, 441; 24/204; 2/161 A, DIG. 6; 16/125, 114 R

[56] References Cited

U.S. PATENT DOCUMENTS

| | | | |
|---|---|---|---|
| 1,008,604 | 11/1911 | Lake | 16/114 R X |
| 2,215,116 | 9/1940 | Crary | 224/56 |
| 2,425,245 | 8/1947 | Johnson | 16/114 R |
| 2,608,326 | 8/1952 | Spector | 224/264 |
| 2,808,973 | 10/1957 | Gobble | 224/264 |
| 3,083,366 | 3/1963 | Franges | 16/114 |
| 3,338,028 | 8/1967 | Freeman | 24/204 X |
| 3,533,407 | 10/1970 | Smith | 128/165 |
| 3,598,408 | 8/1971 | Klose | 273/54 B |
| 3,941,159 | 3/1976 | Toll | 24/204 X |

*Primary Examiner*—Andrew V. Kundrat

*Attorney, Agent, or Firm*—Gausewitz, Carr, Rothenberg & Edwards

[57] ABSTRACT

An elongated, generally hourglass shaped weight-cushioning device for attachment to the handles of a bowling ball carrying bag has an outer layer of relatively thin vinyl material and a somewhat thicker inner layer of foam padding material. The outer layer has a shape substantially identical to but slightly longer than that of the inner layer. In constructing the device, the layers are superimposed with an end of the first layer being aligned with an end of the second layer. The layers are then simultaneously bent longitudinally and attached by a continuous line of stitches around and adjacent the peripheral edges of the layers in a manner such that, subsequent to the attachment, the peripheral edges of the outer and inner layers are brought into congruent alignment. This imparts a slight longitudinal curvature to the device, the outer layer being curved outwardly of the inner layer. In use, the device is longitudinally rolled, foam side inward, around the abutting handle tops until an end of the device overlaps an opposite end adjacent the upper surfaces of the handle tops, the rolling being facilitated by the natural curvature of the device. Mating hook and pile fasteners attached to the overlapping end surfaces removably secure the device around the handles. The lateral hourglass indentations give the sides of the rolled device an upward and outward taper, allowing it to conform to and comfortably pad both the lower surfaces and the longer upper surfaces of the abuttng handle tops as well as their outer sides.

22 Claims, 8 Drawing Figures

WEIGHT-CUSHIONING DEVICE FOR HANDLES AND METHOD OF CONSTRUCTING SAME

BACKGROUND OF THE INVENTION

1. Field of the Invention

This invention relates to a weight-cushioning device, for attachment to the handles of a bowling ball carrying bag, and a method of constructing the device.

2. Description of the Prior Art

The carrying of heavy bowling balls to and from the bowling lanes has long been a source of discomfort and fatigue for the bowler—often to the very fingers which must impart the accuracy required for a successful match. Most bowling balls weigh from fourteen to sixteen pounds. Along with bowling accessories, such as shoes, gloves, and towels, the ball is customarily lugged about in a specially designed carrying bag having hard, narrow, and decidedly uncomfortable handles. These handles tend to cut off circulation to and numb the fingers on the carrying hand when this tiresome load is transported any appreciable distance. Severely compounding this problem is the recent advent of double ball carrying bags which concentrate twice the load, at least 32 pounds in the case of regulation balls, along the same finger-numbing handles.

Prior art devices have not successfully solved this problem. In the case of the much thinner cord or wire handles on various other types of carrying bags, such as shopping bags and the like, rather simple devices have been implemented to protect the carrying hand. Such devices, however, amount to little more than narrow pads (with upturned, noncushioning sides) which are designed to receive and contact only the undersides of the thin cord or wire carrying handles. The prior art devices are not removably attachable around the bag handles, but usually must be repositioned under the handles each time the bag is picked up. Furthermore, in use, such devices do not form a comfortably padded surface which contacts and conforms to the curved inner surfaces of both the fngers and hand when the handles are gripped. Rather, they have a relatively narrow cross section which contacts only the fingers of the carrier's hand as would the cord or wire without the use of such devices. In short, prior art devices were neither designed for nor readily adaptable for comfortable use on the harder and thicker handles of a bowling bag.

SUMMARY OF THE INVENTION

This invention provides a device removably attachable around the abutting upper portions of the handles of a bowling ball carrying bag for substantially reducing the finger discomfort and fatigue often experienced by a person who carries the bag, with its normally hard, narrow handles and heavy contents, any appreciable distance. The invention also provides a simple method for constructing the device in a manner which imparts a useful longitudinal curvature thereto.

The device includes an elongated cushioning member formed from an outer layer and an abutting inner layer. The outer layer is of a relatively thin, pliable material having an hourglass shape. The inner layer is of a somewhat thicker foam padding material having a shape substantially identical to that of the outer layer with the exception that the outer layer is slightly longer than the inner layer.

In constructing the cushioning member, the inner layer is superimposed, in layered fashion, upon the outer layer with an end of the inner layer being aligned with an end of the outer layer. The superimposed layers are then longitudinally bent, in a manner allowing relative longitudinal movement between at least portions of the abutting surfaces of the layers during such bending, with the outer layer being curved outwardly of the inner layer. Simultaneously with this bending, the layers are attached in a manner such that, subsequent to the attachment, the peripheral edges of the layers are brought into congruent alignment, thereby forming a common peripheral edge upon the assembled cushioning member. This in turn imparts to the cushioning member a slight longitudinal curvature.

Edge protecting means are also attached around and adjacent the entire length of the cushioning member peripheral edge simultaneously with the bending and attachment of the outer and inner layers. This protects the edge from wear, prevents separation of the outer and inner layers adjacent the edge, and improves the appearance of the assembled cushioning member.

Mutually and removably engageable fastening means are then attached to the outer and inner layers adjacent longitudinally opposite ends of the cushioning member. In use, the cushioning member is bent longitudinally and rolled around the abutting upper portion of the handles so that the fastening means on the inner layer outwardly overlaps and engages the fastening means upon the outer layer, with the engaged fastening means being adjacent and above the upper portions of the handles.

When the device is thus attached, the narrowest part of the cushioning member, defined by the aligned lateral hourglass indentations of the outer and inner layers, faces downwardly towards the bag. These lateral indentations give the sides of the attached device an upward and outward taper, allowing it to conform to and comfortably pad both the lower surfaces and the longer upper surfaces of the abutting handle tops as well as their outer sides.

The device is easily and quickly attached around bag handles of different dimensions due to the overlapping attachment means. The curved configuration of the device facilitates its longitudinal wrapping around the handles for such attachment. Additionally, the device is easily and quickly removed from the handles and may be readily stored in the bowling bag itself when not in use. Importantly, the attached device effectively cushions the entire perimeter of the abutting handle tops, thus forming an enlarged, padded surface which comfortably contacts not only the fingers of the carrying hand but the inner surface of the hand itself when the bag is carried. When the device is used, the narrow lower surfaces of the abutting handle tops are isolated from the carrier's fingers and prevented from digging into and cutting off circulation to those fingers.

DETAILED DESCRIPTION OF THE PREFERRED EMBODIMENT

Figure 1:
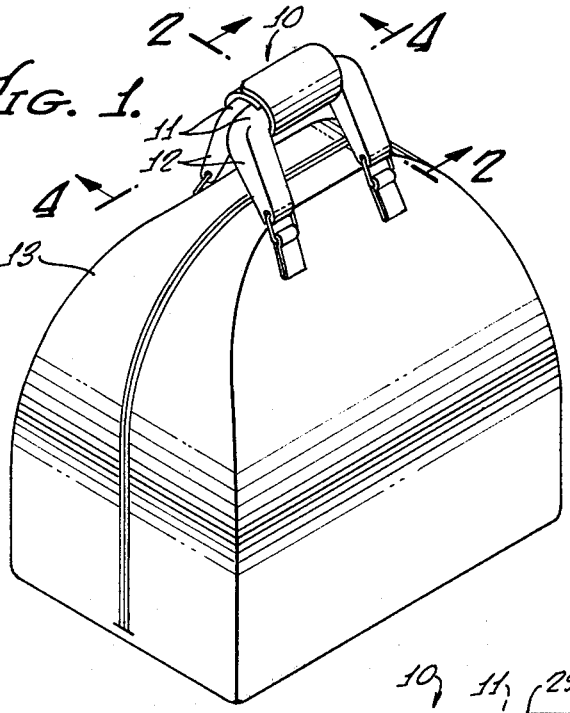
FIG. 1 is a perspective view showing the device in use, attached around the abutting upper portions of the handles of a bowling ball carrying bag.
Figure 3:
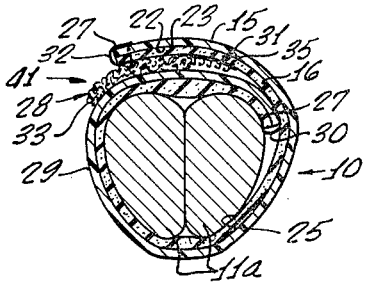
FIG. 3 is a cross-sectional view, similar to that of FIG. 2, showing the device attached to larger bag handles.
Figure 4:
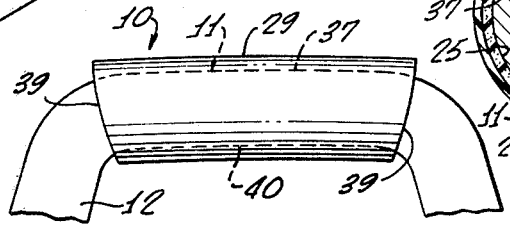
FIG. 4 is an elevational side view of the device in use, taken along line 4—4 of FIG. 1.
Figure 5:
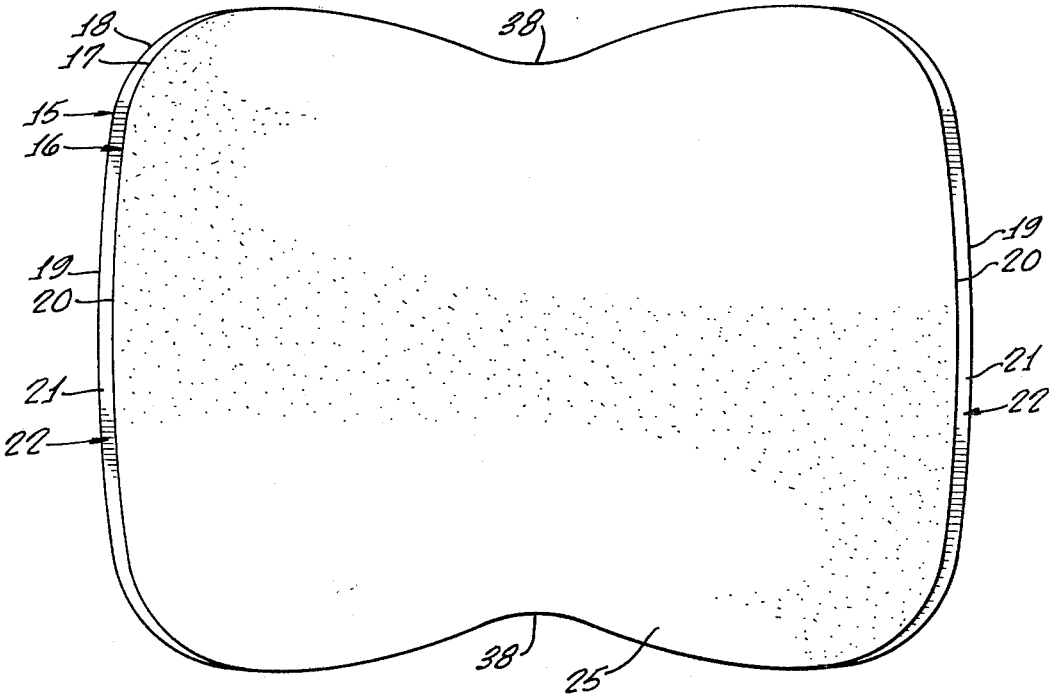
FIG. 5 is a plan view of the two layers of the device, prior to assembly of the device, showing the inner layer being superimposed and centered upon the outer layer.

The weight-cushioning device 10 of this invention is shown assembled and in use, attached around the abutting upper portions 11 of the handles 12 of a bowling ball carrying bag 13, in FIGS. 1 through 4 of the drawings. The device 10 includes an elongated, pliable and resilient cushioning member 14 having an outer or first layer 15 of a relatively thin, pliable material, preferably fabric backed vinyl, and an inner or second layer 16 of a somewhat thicker, pliable and resilient material, preferably a foam cushioning material. The first layer 15 and the second layer 16 have a substantially identical hourglass shape except that the first layer 15 is slightly longer than the second layer 16. The widths of the layers 15 and 16 are the same. The shape and size comparison is best illustrated by FIG. 5 of the drawings which shows the second layer 16 superimposed and centered upon the first layer 15 prior to assembly of the cushioning member 14. It can be seen that the peripheral edge 17 of the second layer 16 is aligned with the peripheral edge 18 of the first layer 15 along the sides of the layers 15 and 16. However, the ends 19 of the first layer 15 protrude slightly beyond the ends 20 of the second layer 16 forming symmetrical exposed areas 21 upon the inner surface 22 of the first layer 15.

Figure 7:
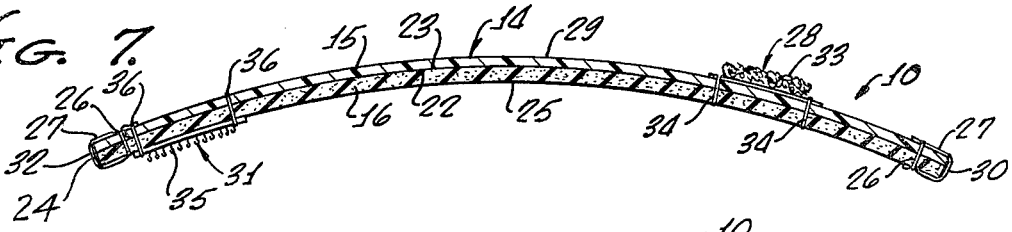
FIG. 7 is a longitudinal cross section through the device, taken along line 7—7 of FIG. 6, showing the natural longitudinal curvature of the device.

In constructing the cushioning member 14, the first layer 15 is congruently aligned with and joined to the second layer 16 with the inner surface 22 of the first layer 15 abutting the inner surface 23 of the second layer 16. This forms a common peripheral edge 24 on the assembled cushioning member 14. Because the first layer 15 is slightly longer than the second layer 16, it is necessary to slightly longitudinally bend the abutting layers, with the first layer 15 being curved outwardly of the second layer 16, to align the ends 19 and 20 prior to or during such joining. When the first layer 15 and the second layer 16 are joined in this manner, a natural inward curvature is imparted to the cushioning member 14, as illustrated in FIG. 7 of the drawing. This natural curvature of the cushioning member 14 facilitates a further inward bending of the cushioning member 14 as subsequently described.

In the preferred method of constructing the cushioning member 14, the layers 15 and 16 are positioned in a layered relationship with their inner surfaces 22 and 23 abutting and with an end 20 of the second layer 16 aligned with an end 19 of the first layer 15. The layers 15 and 16 are then longitudinally bent, in a manner allowing relative longitudinal movement between at least portions of the abutting inner surfaces 22 and 23 during the bending, with the first layer 15 being bent outwardly of the second layer 16. Simultaneously with this bending, the layers 15 and 16 are attached to each other by a continuous line of stitching 26 which extends completely around and slightly inward of the peripheral edge 24 of the cushioning member 14. The simultaneous bending and attaching of the layers 15 and 16 is performed in a manner such that subsequent thereto the peripheral edges 18 and 17 of the layers 15 and 16 are aligned, thereby retaining the longitudinal curvatures imparted to the layers 15 and 16 during the bending.

Figure 6:
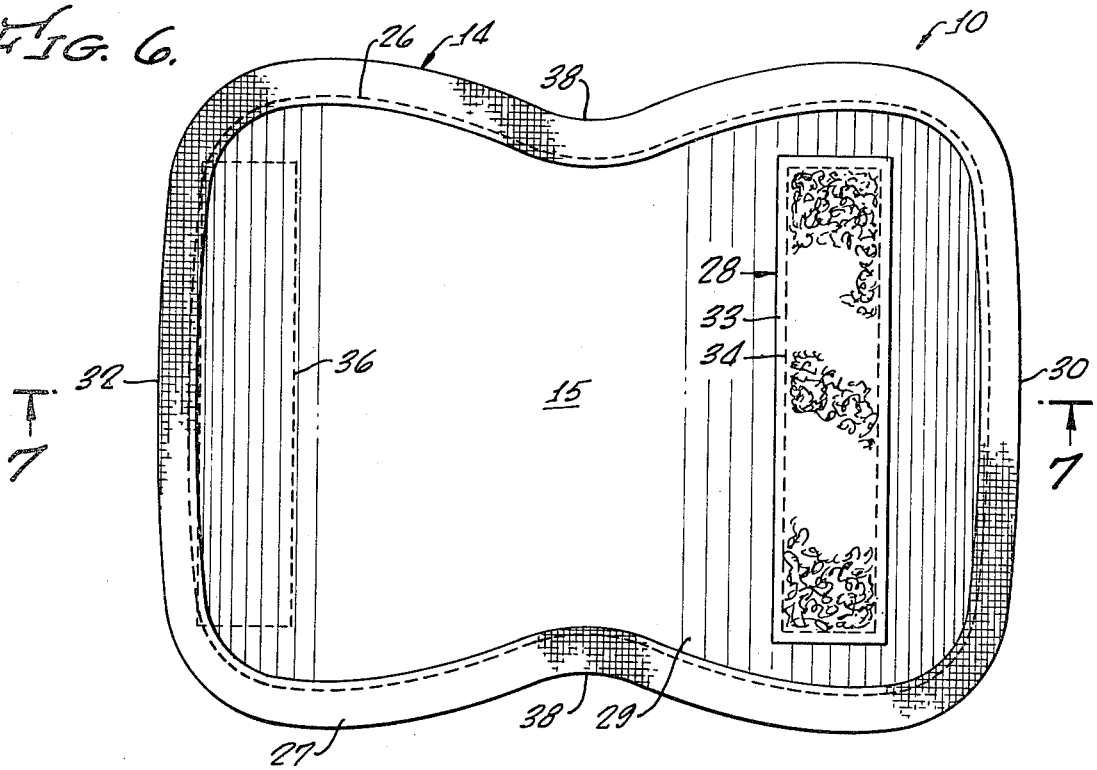
FIG. 6 is a top plan view of the assembled device.
Figure 8:
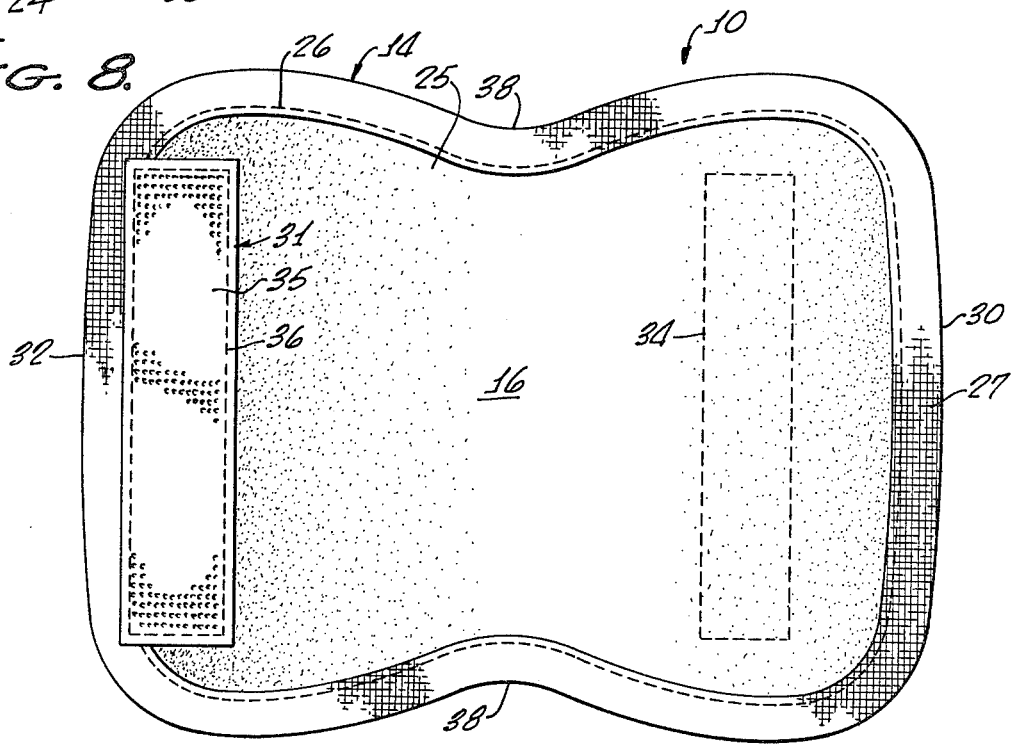
FIG. 8 is a bottom plan view of the assembled device.

The stitching 26 is also used to simultaneously attach an edge protecting means or cloth trim strip 27 around the peripheral edge 24, as shown in FIGS. 6 through 8 of the drawing. The trim strip 27 protects the peripheral edge 24 from wear, prevents the separation of the first layer 15 from the second layer 16 adjacent the peripheral edge 24, and improves the overall appearance of the cushioning member 14.

Referring to FIGS. 6 through 8 of the drawings, a first attachment means or member 28 is secured to the outer surface 29 of the first layer 15 adjacent an end 30 of the cushioning member 14. A second attachment means or member 31, removably fastenable to the first attachment member 28, is secured to the outer surface 25 of the second layer 16 adjacent the opposite end 32 of the cushioning member 14. In the preferred embodiment of the invention, the first attachment member 28 is an elongated strip 33 of pile material which is secured transversely to the cushioning member 14 by a continuous line of stitching 34, and the second attachment member 31 is an elongated strip 35 of hook elements secured transversely to the cushioning member 14 by a continuous line of stitching 36. The strips 33 and 35 are hook and pile fasteners sold under the trademark "Velcro." It should be noted that the strip 35 is closely adjacent the end 32 of the cushioning member 14 while the strip 33 is further away from the end 30 of the cushioning member 14. This dissimilar spacing of the strips 33 and 35 allows for circumferential adjustment of the device 10 when in use, as more fully described later.

Figure 2:
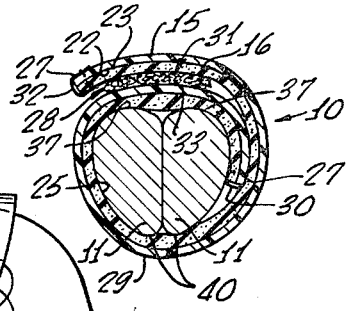
FIG. 2 is an enlarged cross-sectional view of the device in use, taken along section line 2—2 of FIG. 1.

In use, the device 10 is longitudinally inserted through the openings of the handles 12 with the second layer 16 facing the upper portions 11 of the handles 12. The device 10 is then longitudinally bent upwardly and rolled around the upper portions 11 until the end 32 of the cushioning member 14 outwardly overlaps the end 30 and the fastening strips 33 and 35 are brought into alignment adjacent to and above the top surfaces 37 of the upper portions 11 of the handles 12. This bending and folding process is facilitated by the natural curvature of the cushioning member 14. The fastening strips 33 and 35 are then engaged, the device 10 circumscribing the abutting upper portions 11 of the handles 12, as indicated in FIG. 2 of the drawings.

Because of the lateral indentations 38 in the first layer 15 and the second layer 16, the sides 39 of the attached device 10 taper upwardly and outwardly. This allows the attached device 10 to cover and comfortably pad substantially the entire length of both the top surfaces 37 and the bottom surfaces 40 of the upper portions 11 of the handles 12, as indicated in FIG. 4 of the drawing.

In addition to affording a quick and efficient method of attaching the device 10 to the handles 12, the use of the fastening strips 33 and 35 yields the additional benefit of providing a degree of potential circumferential adjustment in the device to accommodate a wide variety of handles. FIG. 3 of the drawings is illustrative of this feature, showing the device 10 fastened around the abutting upper portions 11*a* of handles having a larger cross-sectional area than those shown in FIG. 2. Although the fastening strips 33 and 35 are not fully aligned, as in FIG. 2, their overlapping surfaces still allow the device 10 to be satisfactorily attached to these larger handles. As indicated in FIG. 3, the attachment of the device 10 around such larger handles exposes a portion 41 of the strip 33 to contact by the user's hand when the bag 13 is carried. However, as previously noted, the strip 33 is, in the preferred embodiment of this invention, the soft pile portion of a hook and pile fastening system. Therefore, even when a portion of the fastening strip 33 is thus exposed, a rough surface does not contact the user's hand.

The device 10, when attached to the handles 12 as previously described, simply and quickly provides a wider and more comfortable padded surface completely around the otherwise narrower and much harder handles, thereby substantially alleviating the discomfort and fatique previously associated with the carrying of the bag 13 and its heavy contents.

The foregoing detailed description is to be clearly understood as given by way of illustration and example only, the spirit and scope of this invention being limited solely by the appended claims.

I claim:

1. A weight-cushioning device for attachment around the abutting upper portions of the handles on a hand-carried container, said device comprising:

a first layer of a relatively thin, pliable material, said first layer having a peripheral edge defining an elongated shape including symmetrical, oppositely disposed first and second lateral indentations, the innermost points of said indentations being adjacent the central portion of said first layer;

a second layer of a pliable and resilient material abutting said first layer and having a thickness somewhat greater than that of said first layer, said second layer having a peripheral edge defining a shape substantially identical to but at least slightly shorter than that of said first layer, said peripheral edges of said first and second layers being in congruent alignment, said first and second layers thereby having a longitudinal curvature, said first layer being curved outwardly of said second layer;

a continuous line of stitches through said first and second layers around and adjacent said congruently aligned peripheral edges, said line of stitches fixedly attaching said first and second layers so that said longitudinal curvature of said first and second layers is retained, and facilitating a bending of said first and second layers, thus attached, in a manner increasing said curvature;

a strip of hook elements fixedly attached to and extending transversely of said second layer closely adjacent an end of said device;

a strip of pile material fixedly attached to and extending transversely of said first layer adjacent a longitudinally opposite end of said device, said strip of pile material being longitudinally positioned more inwardly than said strip of hook elements, said strip of hook elements and strip of pile material being removably fastenable to each other; and an elongated cloth trim strip extending longitudinally and folding laterally around said peripheral edges of said first and second layers so that the longitudinal edges of said trim strip extend inwardly along said first and second layers, said trim strip being attached to said first and second layers by said continuous line of stitches.

2. A cushioning device adapted to be wrapped around and removably attached to the abutting handles of a hand-carried container comprising a first layer of relatively thin pliable material, a second layer of relatively thick pliable and resilient material, said first layer overlying said second layer and being longer than said second layer, means for joining the entire peripheral edge portions of said first and second layers so that said edge portions are in substantial congruent alignment to provide a common peripheral edge and said layers are curved longitudinally so as to be concave on the side of said second layer, a first fastener means on the first layer and adjacent one end of said first layer, and a second fastener means on the second layer and adjacent the end of said second layer opposite from said one end of said first layer, said first and second fastener means being cooperable for forming a removable attachment of said ends upon wrapping of said device around the handles of a container.

3. A device as recited in claim 2 wherein said joining means includes a continuous line of stitches through said first and second layers around said peripheral edge portions.

4. A device as recited in claim 3 further comprising means for protecting said peripheral edge portions from wear and for preventing separation of said first and second layers adjacent said peripheral edge portions.

5. A device as recited in claim 4 wherein said edge protecting means includes an elongated cloth trim strip longitudinally extendng and folding laterally around said peripheral edge portions of said first and second members so that the longitudinal edges of said trim strip extend inwardly along said first and second layers, said trim strip being attached to said first and second layers by said continuous line of stitches.

6. A device as recited in claim 2 wherein said first and second layers have a shape defining symmetrical oppositely disposed first and second lateral indentations, the innermost points of said lateral indentations being adjacent the central portion of said first and second layers.

7. A device as recited in claim 6 wherein said shape of said first and second layers at least generally defines an hourglass, and said lateral indentations are defined by the inwardly extending portions of the sides of said hourglass.

8. A device as recited in claim 2 wherein said first fastener means comprises a strip of pile material extending transversely of said first layer, and said second fastener means comprises a strip of hook elements extending transversely of said second layer, said strip of hook elements being closely adjacent said end of said second layer, and said strip of pile material being spaced relatively more inwardly from said one end of said first layer.

9. A method of constructing a weight-cushioning device attachable around the abutting upper portions of the handles on a hand-carried container, said method comprising the steps of:

(a) forming a pliable first layer;

(b) forming a pliable and resilient second layer, said first and second layers each having a peripheral edge defining an elongated shape, and a longitudinal axis, and wherein said forming step (a) includes providing said first layer with a length at least slightly longer than that of said second layer, and wherein said shapes of said first and second layers are otherwise made substantially identical;

(c) positioning said first and second layers in an abutting, layered relationship with said longitudinal axes of said first and second layers substantially parallel;

(d) longitudinally bending said first and second layers to substantially identical longitudinal curvatures; and, (e) attaching said first and second layers in a manner such that subsequent to said attaching, said first and second layers retain said longitudinal curvatures and abutting, layered relationship, and wherein said peripheral edges of said first and second layers are brought into a substantially congruent alignment during said attaching step.

10. A method as recited in claim 9 wherein said positioning and bending steps (c) and (d) are performed in a manner such that subsequent to said attaching step (e), said first layer is curved outwardly of said second layer.

11. A method as recited in claim 9 wherein said attaching step (e) includes providing a continuous line of stitches through said first and second layers.

12. A method as recited in claim 9 wherein said positioning step (c) is performed prior to said bending step (d), and said bending is performed in a manner permitting relative longitudinal movement between at least portions of said first and second layers during said bending.

13. A method as recited in claim 12 wherein said bending and attaching steps (d) and (e) are performed simultaneously.

14. A method as recited in claim 9 wherein said positioning step (c) includes aligning an end portion of said peripheral edge of said first layer with an end portion of said peripheral edge of said second layer.

15. A method as recited in claim 14 wherein said forming steps (a) and (b) include providing, respectively, said first and second layers with symmetrical, oppositely disposed lateral indentations, the innermost point of each of said lateral indentations being located adjacent a central portion of the layer having said indentation.

16. A method as recited in claim 15 wherein said forming step (b) includes providing said second layer with a thickness somewhat greater than that of said first layer.

17. A method as recited in claim 9 further comprising the steps of:

(f) attaching a first fastening member to said first layer adjacent an end of said first layer, and inward of said peripheral edge of said first layer, and (g) attaching a second fastening member to said second layer adjacent an end of said second layer and inward of said peripheral edge of said second layer, said first and second fastening members being mutually and removably engageable, and wherein said first and second fastening members are located on longitudinally opposite ends and nonabutting surfaces of said first and second layers subsequent to said attaching step (e).

18. A method as recited in claim 17 wherein said attaching step (f) includes positioning said first fastening member closely adjacent said end of said first layer, and wherein said attaching step (g) includes positioning said second fastening member relatively more inwardly of said end of said second layer.

19. A method as recited in claim 18 wherein said first fastening member is a strip of pile material and said second fastening member is a strip of hook elements, and wherein said attaching step (f) includes positioning said first fastening member transversely of said first layer and said attaching step (g) includes positioning said second fastening member transversely of said second layer.

20. A method as recited in claim 9 additionally comprising the further steps of forming edge protecting means around said peripheral edges of said first and second layers for protecting said edges and preventing separation thereof.

21. A method as recited in claim 20 wherein said further step is performed by attaching an elongated cloth trim strip to said first and second layers, said trim strip longitudinally extending and folding laterally around said peripheral edges with the longitudinal edges of said trim strip extending inwardly along said first and second layers, said trim strip being attached to said first and second layers by a continuous line of stitches therethrough.

22. A method as recited in claim 21 wherein said further step is performed simultaneously with said attaching step (e).

* * * * *